United States Patent [19]

Glynn

[11] 4,330,020

[45] May 18, 1982

[54] VENTILATING ENTRY-PROOF WINDOW

[76] Inventor: Thomas J. Glynn, 3923 Foster Ave., Brooklyn, N.Y. 11203

[21] Appl. No.: 827,432

[22] Filed: Aug. 24, 1977

[51] Int. Cl.[3] ..... E06B 3/32

[52] U.S. Cl. ..... 160/90; 49/63

[58] Field of Search ..... 160/90, 91; 49/61, 63, 49/372; 98/88 L

[56] References Cited

U.S. PATENT DOCUMENTS

| | | | |
|---|---|---|---|
| 1,344,529 | 6/1920 | White | 49/63 |
| 2,305,445 | 12/1942 | Poor et al. | 160/90 UX |
| 2,355,803 | 8/1944 | Hopewell | 160/91 X |
| 2,777,176 | 1/1957 | Packard | 49/61 X |
| 2,818,919 | 1/1958 | Sylvan | 49/63 X |

*Primary Examiner*—Philip C. Kannan

*Attorney, Agent, or Firm*—Brumbaugh, Graves, Donohue & Raymond

[57] ABSTRACT

A ventilating, entry- and rainproof window which includes a fixed thermalpane window between a pair of louvers mounted to a common frame and a pair of thermalpane windows slidably mounted behind the louvers and the fixed window so that the louvers can be opened and closed for ventilation while at the same time barring access.

4 Claims, 4 Drawing Figures

VENTILATING ENTRY-PROOF WINDOW

This invention relates to a novel window construction, and more particularly to an entry- and rainproof window in which the ventilation is provided through louvers.

The novel window of the present invention includes a fixed thermalpane weather-proof window interposed between a pair of entry- and rainproof louvers mounted to a common frame. The frame, in turn, is mountable within a window opening of a wall. Since the fixed window is not intended to be used for ventilation, it does not require any moving components. Ventilation and protection against rain is provided by the louvers adjacent both sides of the fixed window. Screens are preferably mounted behind the louvers and ventilation can be controlled by a pair of windows slidably mounted from closed positions behind the louvers to open positions behind the fixed window.

The louvers are preferably durably constructed so that access cannot be made through the window by tearing out the louver bars. Also, the individual louver bars are preferably slanted and provided with depending legs at the front and upstanding legs at the rear to make the louvers rainproof and to cut off a line of vision through the louver.

For a more complete understanding of the invention reference can be made to the detailed description which follows and to the accompanying drawings, in which.

Figure 1:
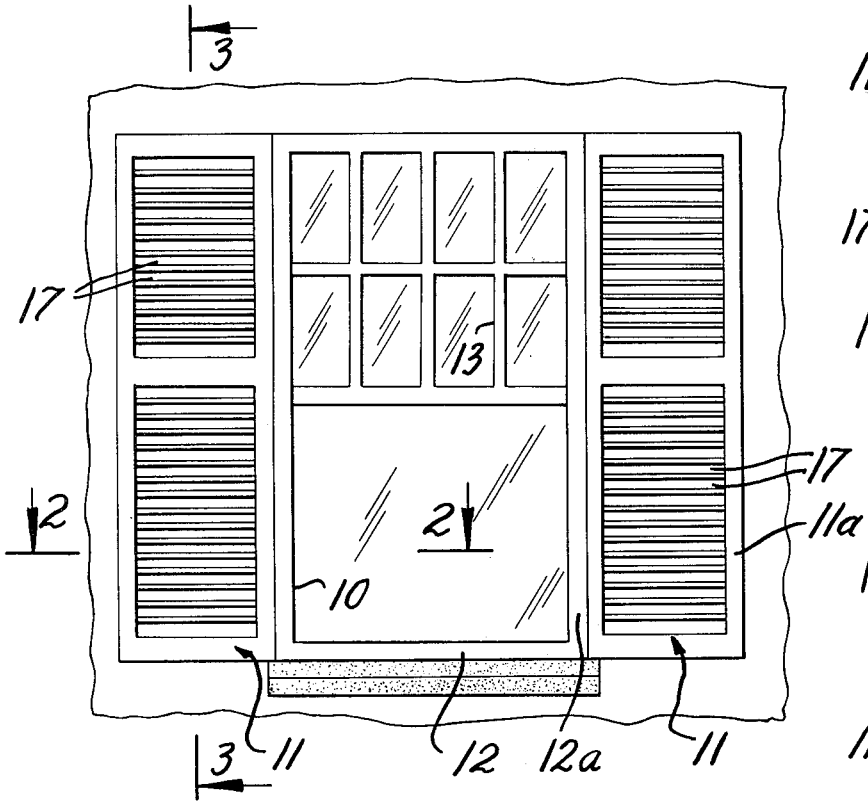
FIG. 1 is an elevational view of the outside of the window construction of the present invention.
Figure 3:
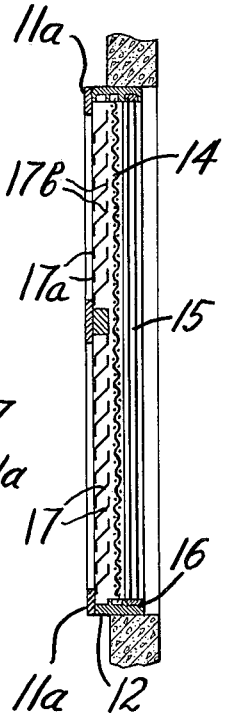
FIG. 3 is a view taken along the line 3—3 of FIG. 1 looking in the direction of the arrows.
Figure 4:
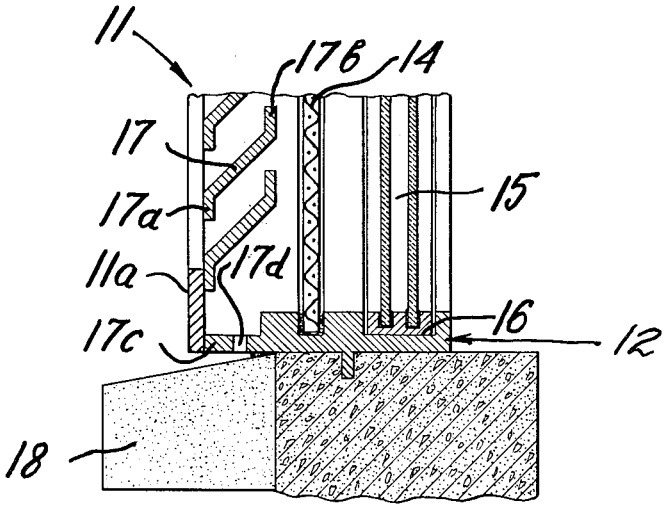
FIG. 4 is an enlarged view of the lower portion of FIG. 3.
Figure 2:
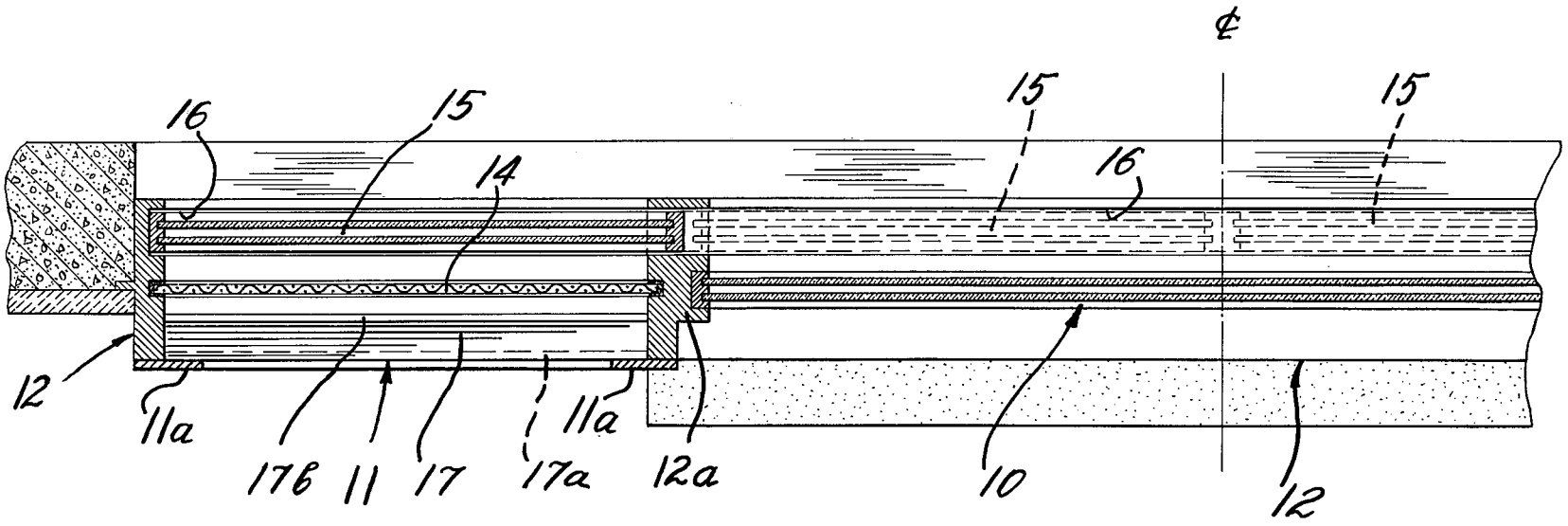
FIG. 2 is a view taken along the line 2—2 of FIG. 1 looking in the direction of the arrows.

The ventilating and entry- and rainproof window of the present invention, as shown in FIG. 1, includes a fixed thermalpane window 10 interposed between a pair of louvers 11 mounted to a common frame 12. The frame 12 generally conforms to the size of the wall opening in which the window is to be mounted. The fixed window 10 is mounted between a pair of vertical frame members 12*a* which extend between the upper and lower legs of the frame. The louvers 11 can be mounted within the confines of the frame 12, or preferably, as shown in the drawings, they are mounted to the front of the frame 12 and have shutter-like frames 11*a* affixed to the front faces thereof so as to simulate conventional hinged shutters.

The fixed window 10 is shown with mullions 13 in the upper portion of the window to simulate a conventional double-hung window. However, the intermediate fixed window can be made of clear thermal glass without mullions.

The louvers 11 provide air flow passages for ventilation while preventing unauthorized access into the building. Toward this end, the louvers are preferably made of strong and durable material. A screen 14 is mounted within the frame 12 at each end adjacent the respective frame member 12*a* directly behind the respective louver.

The louvered window passage can be closed and opened by a slidable thermalpane window 15 directly behind the respective screen 14. The windows 15 are guided for transverse movement by upper and lower tracks 16 mounted directly behind the upper and lower spans of the frame 12. The windows 15 can be shifted from their closed, sealed positions behind the louvers 11 to their open positions directly behind the central window 10 by sliding them toward each other into edge-to-edge relationship. Toward this end, the width of the central window 10 is about twice the widths of each louver 11 and each slidable window 15. In this way, when the slidable windows 15 are in their edge-to-edge positions directly behind the fixed central window 10 the louvers 11 will be fully open.

To prevent outsiders from looking through the louvers and to prevent rain from passing through the louvers, the louver bars 17 are sloped downwardly from rear to front and depending legs 17*a* extend downwardly at the front edges of the bars and upstanding legs 17*b* extend upwardly at the rear edges of the bars. The depending and upstanding legs 17*a* and 17*b* cut off the line of sight through the louver. Also, any rain drops which strike the louver will be carried downwardly and outwardly by gravity. The lower edge 17*c* of the louver is channel shaped and is provided with drain or weep holes 17*d* therein to carry off moisture. If desired, a lower sill 18 can be provided beneath the fixed central window 10.

The invention has been shown in a single preferred form and by way of example, and obviously many variations and modifications may be made therein within the spirit of the invention. The invention, therefore, is not intended to be limited to any specified form or embodiment except in so far as such limitations are expressly set forth in the claims.

I claim:

1. A window comprising an outer frame mountable within an opening in a wall, a pair of louvers mounted at the ends of the frame, a fixed window mounted in the middle of the frame between the louvers, a window mounted within the outer frame behind each louver and a slide mounting for said windows within the outer frame and behind the louvers and the fixed window to permit the windows to be shifted from a closed position directly behind the respective louver to a partly open position to an open position directly behind the fixed window.

2. A window as set forth in claim 1 in which the slide mounting includes upper and lower window guides mounted to the upper and lower ends of the frame.

3. A window as set forth in claim 1 in which each louver and slidable window is approximately half the width of the fixed window so that when the slidable windows are moved from closed to open positions they will assume positions behind the fixed window.

4. A window as set forth in claim 1 in which the louvers are mounted on the frame forwardly of the fixed window to simulate conventional shutters.

* * * * *